US009543087B2

(12) United States Patent
Pisu et al.

(10) Patent No.: US 9,543,087 B2
(45) Date of Patent: Jan. 10, 2017

(54) CONTACT SYSTEM

(71) Applicant: ABB Schweiz AG, Baden (CH)

(72) Inventors: Francesco Pisu, Birmenstorf (CH); Jadran Kostovic, Wettingen (CH); Sami Kotilainen, Niederrohrdorf (CH); Timothy Sutherland, Zweidlen (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/711,254

(22) Filed: May 13, 2015

(65) Prior Publication Data

US 2015/0248976 A1 Sep. 3, 2015

Related U.S. Application Data

(63) Continuation of application No. PCT/EP2013/073317, filed on Nov. 8, 2013.

(30) Foreign Application Priority Data

Nov. 13, 2012 (EP) ..... 12192468

(51) Int. Cl.
*H01H 9/38* (2006.01)
*H01H 1/38* (2006.01)
(Continued)

(52) U.S. Cl.
CPC ..... *H01H 9/386* (2013.01); *H01H 1/38* (2013.01); *H01H 1/44* (2013.01); *H01H 1/46* (2013.01); *H01H 1/50* (2013.01)

(58) Field of Classification Search
CPC ..... H01H 1/00; H01H 1/38; H01H 1/44; H01H 1/46; H01H 1/50
(Continued)

(56) References Cited

U.S. PATENT DOCUMENTS 4,206,331 A * 6/1980 Kii ..... H01H 33/98 218/114
4,628,164 A * 12/1986 Talpo ..... H01H 33/12 200/258
(Continued)

FOREIGN PATENT DOCUMENTS

DE 3613608 C1 8/1987
EP 0856860 A2 8/1998

OTHER PUBLICATIONS

Machine Translation EP0856860 (orginal doc. published May 8, 1998).*
(Continued)

*Primary Examiner* — Renee S Luebke
*Assistant Examiner* — William Bolton
(74) *Attorney, Agent, or Firm* — Whitmyer IP Group LLC

(57) ABSTRACT

An electrical switching device including at least a nominal contact arrangement, the nominal contact arrangement at least a first nominal contact with a plurality of nominal contact fingers forming a finger cage concentric with respect to a longitudinal axis (z), and at least a mating second nominal contact. An arcing contact arrangement including a first arcing contact and a mating second arcing contact. An arcing contact finger including at its free end a first impact area in which a first contacting to the second arcing contact occurs when closing, the electrical switching device. The first impact area is formed by a first planar surface arranged at an inclination angle (α) larger than zero degrees with respect to the longitudinal axis (z).

20 Claims, 4 Drawing Sheets

(51) Int. Cl.
*H01H 1/44* (2006.01)
*H01H 1/46* (2006.01)
*H01H 1/50* (2006.01)

(58) Field of Classification Search
USPC ..... 218/16, 18, 13, 21, 51, 52, 66, 65, 126,218/57; 200/238
See application file for complete search history.

(56) References Cited

U.S. PATENT DOCUMENTS 4,745,244 A * 5/1988 Spinner ..... H01H 1/46 200/258
4,935,590 A * 6/1990 Malkin ..... H01H 33/72 218/57
5,105,058 A * 4/1992 Perret ..... H01H 33/16 218/65
5,654,532 A * 8/1997 Meyer ..... H01H 33/91 218/63
6,638,116 B2 * 10/2003 Byron ..... H01R 13/18 439/843
2008/0314873 A1 * 12/2008 Dahlquist ..... H01H 33/7023 218/53

OTHER PUBLICATIONS

European Search Report Application No. EP 12 19 2468 Issued: Apr. 12, 2013 6 pages.
International Preliminary Report on Patentability Application No. PCT/EP2013/073317 Completed: Oct. 28, 2014 6 pages.
International Search Report and Written Opinion of the International Searching Authority Application No. PCT/EP2013/073317 Completed: Jan. 24, 2013; Mailing Date: Feb. 2, 2014 8 pages.

* cited by examiner

CONTACT SYSTEM

RELATED APPLICATIONS

This application claims priority as a continuation application under 35 U.S.C. §120 to PCT/EP2013/073317, which was filed as an International Application on Nov. 8, 2013 designating the U.S., and which claims priority to European Application 12192468.2 filed in Europe on Nov. 13, 2012. The entire contents of these applications are hereby incorporated by reference in their entireties.

FIELD OF THE INVENTION

The present disclosure relates to the field of medium and high voltage switching technologies and concerns an electrical switching device and contact arrangement, such as for use as an earthing switch, fast-acting earthing switch, disconnector, combined disconnector and earthing switch, load break switch, circuit breaker or generator circuit breaker in power transmission or distribution systems.

BACKGROUND INFORMATION

Electrical switching devices are well known in the field of medium and high voltage switching applications. They are for example, used for interrupting a current, when an electrical fault occurs. As an example for an electrical switching device, circuit breakers have the task of opening contacts and keeping them far apart from one another in order to avoid a current flow, even if high electrical potential is originating from the electrical fault itself. For the purposes of this disclosure the term medium voltage refers to voltages from 1 kV to 72.5 kV and the term high voltage refers to voltages higher than 72.5 kV. The electrical switching devices, like the circuit breakers, may have to be able to carry high nominal currents of 5000 A to 6300 A and to switch very high short circuit currents of 63 kA to 80 kA at very high voltages of 550 kV to 1200 kV.

Because of the high nominal current, the electrical switching devices of today require many so-called nominal contact fingers for the nominal current. When disconnecting (opening) a nominal or short circuit current within the electrical switching devices, the current commutates from nominal contacts of the electrical switching device to its contacts. Thus, when connecting (closing) the nominal contacts of the electric switching device, also the arcing contacts are connected. They can include as a first arcing contact arcing contact fingers arranged around the longitudinal axis of the electrical switching device in a so-called arcing finger cage and, as a second arcing contact, a rod which is driven into the linger cage.

The opening and closing processes of the nominal and the arcing contacts have to be carried out with a predefined speed, according to the specification of the electrical switching device. During the closing of the electrical switching, device particularly the arcing contact fingers are subjected to an impact caused by the incoming rod. The impact force acting on the arcing contact fingers depends on the relative closing speed of the contact fingers and the rod. Thus, the higher the speed, the higher is the force acting on the arcing contact fingers. However, a high contact speed is desired, because it improves the performance of the electrical switching device. As a consequence of higher impact forces acting, on the arcing contact fingers, the arcing contact fingers may experience a permanent deformation or ma break. For example, they may be deformed radially outward with respect to the longitudinal axis or may fall apart. A contact force between the arcing contact finger and the second arcing contact has to be high enough to ensure a good electrical contact. Eventually, requirements regarding to contact forces are not met an more because of the deformation.

SUMMARY OF THE INVENTION

An electrical switching device having a longitudinal axis (z) and comprising: at least one contact arrangement, wherein the contact arrangement includes a first contact and a mating second contact, wherein the first contact includes at least one contact finger; wherein the contact finger is configured to be elastically deformed in a radial direction upon closing the switching device; wherein for closing and opening the electrical switching device at least one of the first contact and the mating second contact is movable parallel to the longitudinal axis (z) and cooperates with the other contact; wherein the contact finger includes, at its free end, a first impact area in which a first contacting, to the second contact will occur when closing the electrical switching device; and wherein the first impact area is formed by a first planar surface which is arranged at an inclination angle ($\alpha$) larger than zero degrees with respect to the longitudinal axis (z), wherein the first planar surface is a two-dimensional flat area.

BRIEF DESCRIPTION OF THE DRAWINGS

Further embodiments, advantages and applications will be described herein with reference to the Figures, wherein.

DETAILED DESCRIPTION OF THE INVENTION

Figure 1:
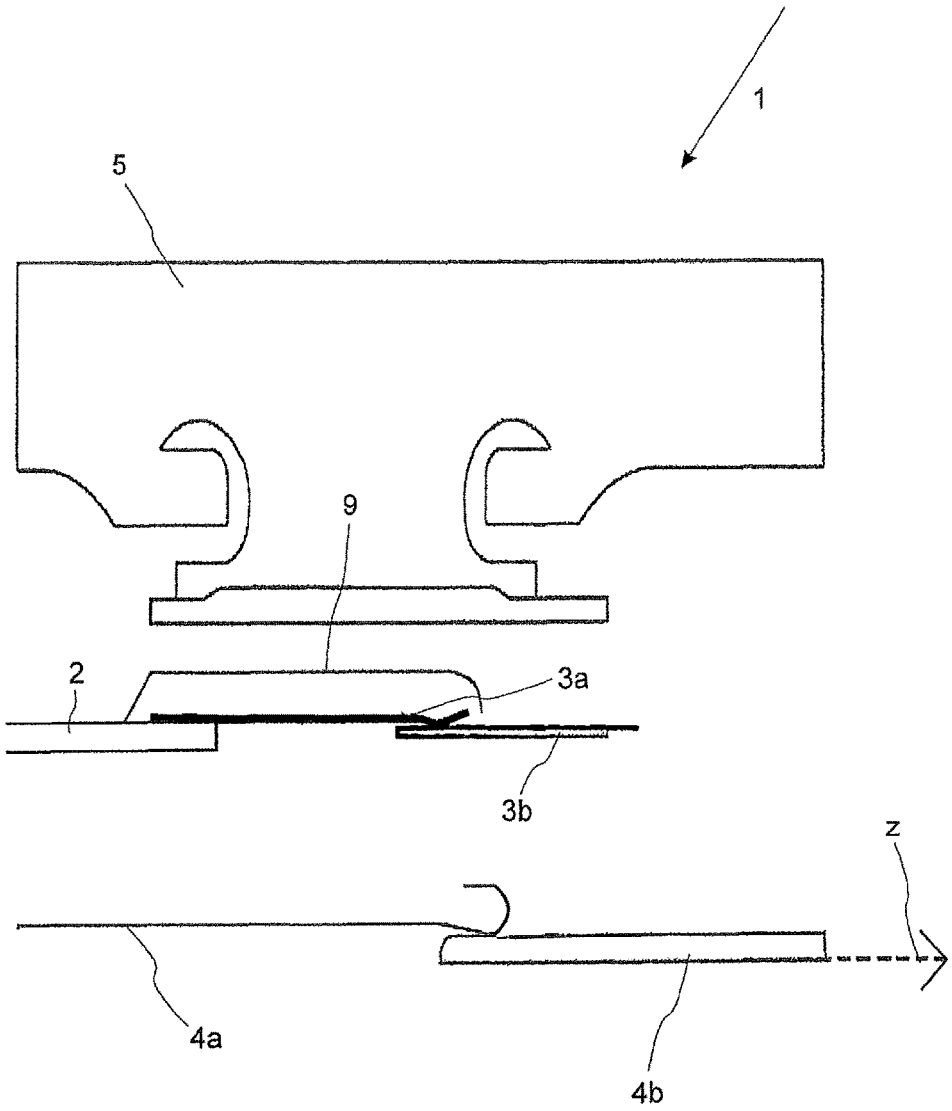
FIG. 1 is a partial sectional view of a simplified exemplary embodiment of a high voltage circuit breaker.

Exemplary embodiments disclosed herein can enhance an electrical switching device in terms of preventing damage to contact fingers of the device.

An exemplary electrical switching device as disclosed includes at least one contact arrangement. The contact arrangement comprises a first contact and a mating second contact, wherein the first contact comprises at least one contact finger. For closing and opening the electric switching device at least one of the contacts is movable parallel to the longitudinal axis and cooperates with the other contact. The contact finger comprises at its free end a first impact area in which a first contacting to the second mating contact occurs when closing the electrical switching device. The first impact area is formed by a first planar surface arranged at an inclination angle $\alpha$ larger than zero degrees with respect to the longitudinal axis. Such inclination angle $\alpha$ being positive signifies that the first planar surface, when looking in an axial direction z towards a free end of the contact finger, is extending in a radially outward direction, i.e. gradually away from the longitudinal axis z, or else in an opening manner under the inclination or opening angle α. Please note that the longitudinal axis z of the electrical switching device is also a longitudinal axis z of the contact arrangement, may it be of the arcing contact arrangement or of the nominal contact arrangement.

The advantage of designing the contact fingers to have an inclined planar first impact area, i.e. inclined such that an opening of the contact finger towards its free end is achieved, is that the impact stress is diminished while maintaining the required contact force between the two arcing contacts.

In embodiments, the at least one contact arrangement is or includes an arcing contact arrangement, the first contact is or comprises a first arcing contact comprising at least one arcing contact finger, and the mating second contact is or comprises a mating second arcing contact. In particular, for closing and opening the electric switching device at least one of the arcing contacts is movable parallel to the longitudinal axis and cooperates with the other arcing contact.

In alternative or additional embodiments, the at least one contact arrangement is or includes a nominal contact arrangement, the first contact is or-includes a first nominal contact having a plurality of nominal contact fingers and forming a finger cage concentric with respect to the longitudinal axis, and the mating second contact is or includes a mating second nominal contact. In particular, for closing and opening the electric switching device at least one of the nominal contacts is movable parallel to the longitudinal axis and cooperates with the other nominal contact.

In an embodiment the arcing contact finger includes a contact area. The first impact area is arranged between the contact area and a tip of the free end of the first contact finger, when seen along the longitudinal axis z. The arcing contact finger is contacting in the contact area with the second arcing contact in an end position of the second arcing contact when the electrical, switching device is closed. The contact area is formed by a second planar surface which in one embodiment of the invention can be parallel to the longitudinal axis.

In an exemplary embodiment the second planar surface (i.e. contact area) is inclined with respect to the longitudinal axis in an opposite angular direction than the inclination direction of the first impact area by a compensation angle or narrowing angle β, wherein narrowing refers to coming radially closer when looking along the longitudinal axis z towards the free end of the contact finger. The compensation angle β can substantially equal a deflection angle of the arcing contact finger when the electrical switching device is in a closed configuration. By designing the contact area to be inclined in the way mentioned above a good electrical contact between the two arcing contacts is ensured.

Such an arrangement advantageously separates the first impact area of the arcing contacts from the actual electrical contact area. Thus, the electrical contact area can be designed in accordance with required electrical parameters without having to take into account requirements related to the impact of the two arcing contacts.

It is particularly advantageous if the second arcing contact includes at its free end a second impact area in which a first contacting to the arcing contact finger occurs when closing the electrical switching device, wherein the second impact area is parallel to the first impact area. This forming of the second arcing contact further reduces the impact stress during closing of the arcing contacts.

In particular, providing a first inclined, two-dimensionally extended and flat impact area cooperating during impacting with a second identically inclined, two-dimensionally extended and flat impact area allows to distribute the impact force evenly over a larger two-dimensional surface and at the same time allows gliding between the first and second impact areas. This concept is in contrast to rounded impact areas which favour gliding under varying impacting angles, but generate one-dimensional or even point-like impact regions which cause very high stress to the impacting first and mating second contacts.

Furthermore it is advantageous that on the arcing contact finger a first transition area between the first impact area and the contact area is rounded and/or on the second arcing contact a mating second transition area of the second arcing contact is rounded. By this, the transition between the impact stage during the closing process to the end position of the second arcing contact in the closed configuration is smoother, such that bouncing effects of the arcing contact finger can be reduced, minimized or even be avoided.

In an embodiment, the nominal contact fingers have the same shape as the arcing contact finger or arcing contact fingers.

An embodiment is described for the example of a high voltage circuit breaker having nominal contacts and arcing contacts, but the principles described in the following also apply for the usage of the invention in other switching devices, e.g. of the type mentioned at the beginning, such as in an earthing switch, fast-acting earthing switch, disconnector, combined disconnector and earthing switch, load break switch, generator circuit breaker, and generally in any switch for high voltage or medium voltage. In particular, an exemplar embodiment is fully applicable in switches having an arcing contact arrangement solely, a nominal contact arrangement solely, or both an arcing contact system and a nominal contact system. An arcing contact arrangement shall encompass a first arcing contact comprising at least one arcing contact finger 4*a*, and a mating second arcing contact 4*b*, which are movable relative to one another. A nominal contact arrangement shall encompass a first nominal contact comprising a plurality of nominal contact fingers 3*a*, and a mating second arcing contact 3*b*, which are movable relative to one another.

FIG. 1 shows a partial sectional view of a simplified basic embodiment of a high voltage circuit breaker 1*a* in a closed configuration. In FIG. 1 "partial section view" means that only the upper half of a section of the circuit breaker is shown, for reasons of clarity. The device, as well as its arcing or nominal contact arrangement(s) as such, is or are rotationally symmetric about a longitudinal axis z. Only the elements of the circuit breaker 1*a* which are related to the present invention are described in the following. Other elements present in the figures are not relevant for understanding the embodiment and are known by the skilled person in high voltage electrical engineering.

A "closed configuration" as used herein means that the nominal contacts and/or the arcing contacts of the circuit breaker are closed. Accordingly, an "opened configuration" as used herein means that the nominal contacts and/or the arcing contacts of the circuit breaker are opened.

The circuit breaker 1*a* can include a chamber enclosed by a shell or enclosure 5 which normally is cylindrical around the longitudinal axis z. It further can include a nominal contact arrangement formed by a first nominal contact including a plurality of contact fingers 3*a*, of which only one is shown here for reasons of clarity. The nominal contact arrangement is formed as a finger cage around the longitudinal axis z. A shielding 9 can be arranged around the finger cage. The nominal contact arrangement further can include a second mating contact 3*b* which normally is a metal tube. The contact fingers 3*a* and the second contact 3*b* are movable relatively to one other from the closed configuration shown in FIG. 1, in which they are in electrical contact with one another, into an opened configuration, in which they are apart from one another, and vice versa. It is also possible that only one of the contacts 3*a*, 3*b* moves parallel to the longitudinal axis z and the other contact 3*b*, 3*a* is stationary along the longitudinal axis z.

The contact fingers 3*a* are attached to or can be a part of a finger support 2, particularly a metal support cylinder 2.

The circuit breaker 1*a* furthermore can include an arcing contact arrangement formed by a first arcing contact 4*a* and a second arcing contact 4*b*.

In an exemplary embodiment of the switching device the first nominal contact and the first arcing contact 4*a* may be movable with respect to one another, as well as the second nominal contact 3*b* and the second arcing contact 4*b*. In another embodiment of the switching device the first nominal contact and the first arcing contact 4*a* are not movable relatively to one another. In the same way, the second nominal contact 3*b* and the second arcing contact 4*b* are not movable with respect to one another. For the explanatory purposes of the present disclosure the latter embodiment is assumed and it is assumed that only the second nominal contact 3*b* and the second arcing contact 4*b* are movable and the finger cage and the first arcing contact 4*a* are stationary along the z-axis.

Figure 2:
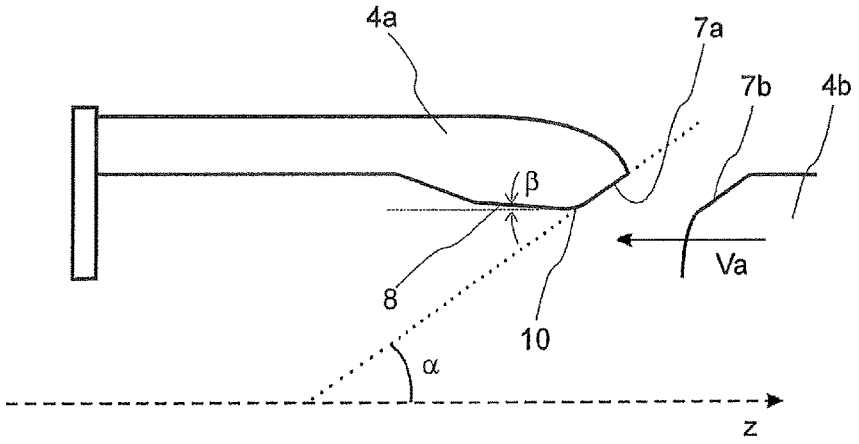
FIG. 2 is a partial sectional view of an exemplary arcing contact finger of a first arcing contact and a second arcing contact before closing.

FIG. 2 shows a partial sectional view of an arcing contact finger 4*a* of the first arcing contact (which may as a whole also be designated as 4*a*) and the second arcing contact 4*b* in the course of being closed.

The second arcing contact 4*b* is moved with a relative axial velocity Va in an opposite direction relative to the arrow denoting the longitudinal axis z.

The arcing contact finger 4*a* has a first impact area 7*a* and the second arcing contact 4*b* has a second impact area 7*b*, which are parallel to one another. Both impact areas 7*a*, 7*b* have an inclination angle α with respect to the longitudinal axis z which is illustrated by the dotted line. Advantageously, the inclination angle α has a magnitude of not more than 15 degrees and not less than 5 degrees. However, in another embodiment the second impact area 7*b* may also be rounded or have another shape.

Furthermore, the arcing contact finger 4*a* has a contact area 8 which is formed, in the opened configuration of the electrical switching device 1, by a second planar surface. The planar surface is inclined with respect to the longitudinal axis z in an opposite angular direction than the inclination direction of the first impact area. 7*a* by a compensation angle β. The compensation angle β substantially equals a deflection angle of the arcing contact finger 4*a* when the electrical switching device 1 is in a closed configuration. The deflection angle can be seen in FIG. 3 and also has the reference numeral β. This exemplary aspect will be explained in the following in relation to FIG. 3. It is noted that the term "planar surface" in the sense of the present disclosure also includes curvatures of not more than 10 degrees. Furthermore, "planar surface" shall encompass only true planar or substantially planar surface areas, but shall exclude rounded or only infinitesimally planar surface areas.

Figure 3:
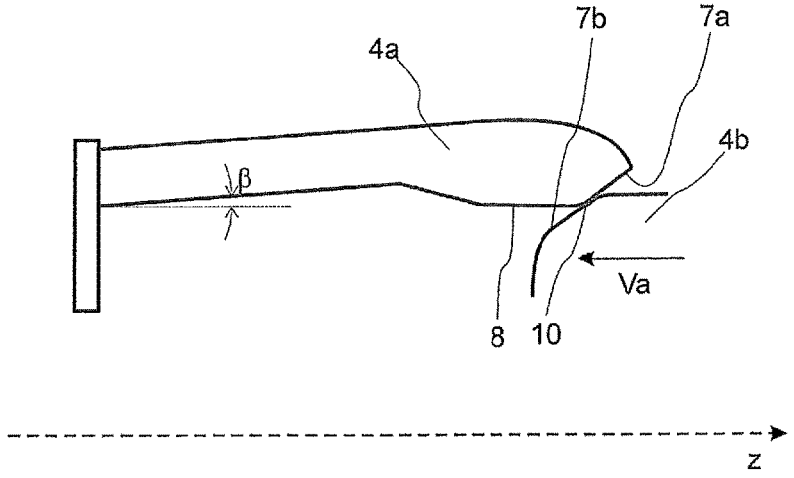
FIG. 3 is a partial sectional view of the arcing contact finger and the second arcing contact of FIG. 2 during closing.

FIG. 3 shows a partial sectional view of the arcing contact finger 4*a* and the second arcing contact 4*b* of FIG. 2 during closing. As can be seen, the second arcing contact 4*b*, which is moved to the left in the figure, has contacted the arcing contact finger 4*a* with its first impact area 7*a* sliding upwards on the second impact area 7*b* of the second arcing contact 4*b*. The deflection angle β will be increasing until the second impact area 7*b* of the second arcing contact 4*b* has arrived at the lower end of the first impact area 7*a* of the arcing contact finger 4*a*. Then, the second arcing contact 4*b* continues sliding over the contact area 8 until it reaches its end position in the closed configuration. In this end position, the contact area 8 lies on top of the second arcing contact 4*b*, as indicated in or inferable from the view of FIG. 3. In this FIG. 3 the deflected arcing contact finger 4*a* is shown to be straight because of simplicity reasons. In reality it can slightly be bent towards the top with respect to the figure orientation. Because of its elasticity, the arcing contact finger 4*a* exerts a resilient force onto the second arcing contact 4*b*, thus ensuring a good electrical contact.

Alternatively, contrary to the slide movement of the arcing contact finger 4*a* on the second impact area 7*b*, the arcing contact finger 4*a* may also bounce up after the first impact with the second arcing contact 4*b*, such that the contact to the second arcing contact 4*b* is lost. When the latter is further moved in the direction of the arrow 7*a* it may not have any further contact to the first impact area. 7*a* but directly with the contact area 8.

In another embodiment of the electrical switching device 1 the contact area 8 is formed by a second planar surface which is inclined with respect to the longitudinal axis z in an opposite angular direction than the inclination direction of the first impact area 7*a*. As mentioned, the contact area 8 is inclined by the compensation angle β which can substantially equal the deflection angle of the arcing contact finger 4*a* when the electrical switching device 1 is in the closed configuration. In other words, the compensation angle β can equal the maximum deflection angle of the arcing contact finger 4*a* when a static closed position is achieved. This has the advantage that the contact area 8 has a maximum contacting area with the second arcing contact 4*b*, because in the deflected position of the arcing contact finger 4*a* the contact area 8 is parallel to the outer surface of the second arcing contact 4*b*. The contact surface 8 may, however, also be parallel with respect to the longitudinal axis z or may have another inclination, or shape, depending on the construction and the inclination of the arcing contact finger 4*a* and the second arcing contact 4*b*. It is noted that the term "angular direction" in the sense of the exemplary embodiments, means a clockwise or a counter-clockwise direction.

In embodiments, a first transition area 10 between the first impact area 7*a* and the contact area 8 is rounded. By this, a bouncing of the arcing contact finger 4*a* is avoided or at least minimized during the closing process of the electrical switching device 1 directly after the second impact area 7*b* of the second arcing contact 4*b* has lost contact with the first impact area 7*a*. In further embodiments, a mating second transition surface of the second arcing contact 4*b* is also rounded in order to provide the smoothest possible transition to the contact area 8.

Figure 4:
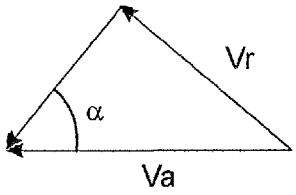
FIG. 4 is an exemplary vector diagram of a closing speed of the second arcing contact and its components.
Figure 5:
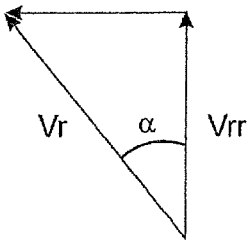
FIG. 5 is an exemplary vector diagram of a radial speed of the second arcing contact and its components.

FIG. 4 shows a vector diagram of the relative axial closing velocity Va and its vector components and FIG. 5 a vector diagram of a radial speed Vr and its vector components. In the following an equation determining the relationship between the inclination angle α and a radial displacement of the arcing contact finger 4*a* is discussed. Advantageously, the inclination angle of the first impact area 7*a* with respect to the longitudinal axis z is given by the equation:

$$d = Va \cdot \sin\alpha \cdot \cos\alpha \cdot \sqrt{\left(\frac{m}{k}\right)} \quad (1)$$

with d being a radial displacement of the arcing contact finger 4*a*, m being a mass of the arcing contact finger 4*a*, k being a finger stiffness of the arcing contact finger 4*a*, Va being a relative axial velocity of the second arcing contact 4*b* relative to the first arcing contact at the time of impact, and a being the inclination angle of the impact surface 7*a*. In particular, the radial displacement d is not greater than a radial clearance dmax of the arcing contact finger 4*a*. The radial clearance dmax refers to the available free space (or maximal radial deflection amplitude) in the direction of deflection of the arcing contact finger 4*a*.

Assuming the arcing contact finger 4*a* is perfectly fixed in space, the relative velocity between the arcing contact finger 4*a* and the second arcing contact 4*b* can be considered as absolute velocity. This also takes into account that the arcing contacts may both be moved towards each other in the course of the closing process. In the present example the axial velocity of the arcing contact finger 4*a* is zero, such that the total absolute velocity is the axial velocity Va of the second arcing contact 4*b*. In relative terms, the arcing contact finger 4*a* "sees" the relative velocity Vr being perpendicular to the plane of the first impact area 7*a*. Focusing on this relative velocity Vr, it can further be divided into its components (FIG. 5) of which a relative radial velocity Vrr is of particular interest. The relative radial velocity Vrr can be derived from the vector diagrams and trigonometric functions as:

$$Vrr = Va \cdot \sin\alpha \cdot \cos\alpha$$

Considering the energy balance of the arcing contact finger as $$m \cdot (Vrr)^2/2 = k \cdot (d)^2/2$$

wherein the variables or constants respectively have been named above, it can be seen that the maximum radial displacement of the arcing contact finger 4*a* is $$d = Vrr \cdot \sqrt{(m/k)}$$

and the relative radial velocity Vrr is a function of the inclination angle α. Considering the above relationships, the result is equation (1) disclosed above. Thus, the maximum radial displacement is a function of the finger mass, the finger stiffness and the radial relative velocity Vrr. Hence, knowing the prescribed relative axial velocity Va for a certain electrical switching device 1 and knowing the maximum allowable displacement dmax, i.e. keeping d=<dmax, it is possible to choose the inclination angle α to fit the requirements for the particular electrical switching device 1.

According to exemplary embodiments, the contact fingers of arcing contacts can be prevented from damage caused by the impact of the arcing contacts during the closing process by providing a smoother impact. Another advantage is that the special shape of the arcing contact fingers allows an increased robustness with respect to contact misalignment. It is noted that the present-disclosure has focused on arcing contacts of electrical switching devices. However, the principles herein may also be applied to the nominal contacts of an electrical switching device. Particularly, the nominal contact fingers may have the same shape as the arcing contact finger. It may also be provided that the second nominal contact 3*b* has an inclined surface of the same shape like the second arcing contact 4*b*.

In another aspect, the present disclosure also relates to a contact arrangement for an electrical switching device 1 as disclosed above and claimed in any of the appended claims, wherein the contact arrangement has a longitudinal axis z and comprises a contact finger 4*a*, 3*a*, which comprises at its free end a first impact area 7*a* in which a first contacting to a second contact 4*b*, 3*b* of the electrical switching device 1 occurs when closing the electrical switching device 1, wherein further the first impact area 7*a* is formed by a first planar surface which is arranged at an inclination angle α larger than zero degrees with respect to the longitudinal axis z.

In other embodiments, the contact arrangement is an arcing contact arrangement and the contact finger is an arcing contact finger 4*a*, and/or the contact arrangement is a nominal contact arrangement and the contact finger is a nominal contact finger 3*a*.

Figure 6:
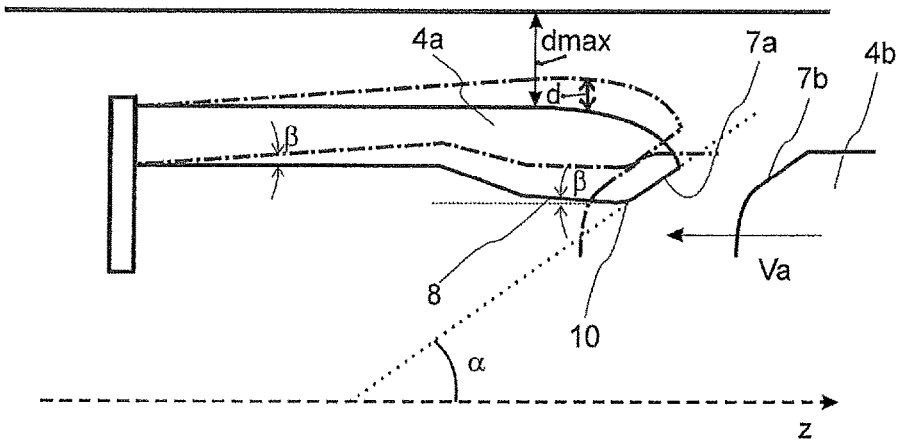
FIG. 6 is an overlapped view of FIGS. 2 and 3.

FIG. 6 is an overlapped view of FIGS. 2 and 3. The deflected first arcing contact finger 4*a* and the respective second arcing contact 4*b* are represented by dash-dotted lines. As can be seen in an integrated view of FIGS. 2, 3 and 6, the second arcing contact 4*b* is moved with the axial velocity Va towards the first arcing contact finger 4*a* (see FIG. 2) at or close to the time of impact. When it impacts the first arcing contact finger 4*a* with the axial velocity Va (which may thus be called axial impact velocity throughout this application), the arcing contact finger 4*a* is radially displaced by the second arcing contact 4*b* (see FIG. 3). It is noted that it has been assumed for simplicity reasons that the first arcing contact 4*a* is stationary (velocity equals zero) and only the second arcing contact 4*b* is moved with the velocity Va. As aforementioned the first arcing contact 4*a* may also be movable such that in this case the axial velocity Va (i.e. axial impact velocity Va) is a resulting velocity or sum velocity (velocity of contact 4*a*+velocity of contact 4*b*). The skilled person will appreciate that the velocity of a high voltage contact is not constant over the entire moving distance of that contact, as it has to be accelerated from zero at its initial location to a velocity of contact with the mating contact. However, such acceleration is not taken into account here. The axial velocity Va which is relevant for the purposes of describing the exemplary embodiments, is the impact velocity, which has been considered constant for the time span between the snapshots of FIGS. 2 and 3 (same velocity numeral in both figures, not represented as a function of time).

FIG. 6 shows schematically the maximum clearance dmax, i.e. the maximum radial displacement or radial deflection of the contact 4*a*. The area above the line defining the maximum clearance dmax (as seen towards the page enumeration) is assumed to be another part of the electrical switching device 1, the precise nature of which is irrelevant for the purposes of the present disclosure. As discussed in connection with equation 1, the radial displacement d or deflection d of the first arcing contact finger 4*a* has to be smaller than dmax, as illustrated in FIG. 6 with d being only a fraction of the double arrow dmax below the intersection point with the dash-dotted line. Please note that the radial displacement of deflection d is typically related to the deflection angle β by d=1*sin(β), wherein 1 designates a distance from a fixation point of the contact finger 4*a* to a head region of the contact finger 4 where the impact occurs.

While there are shown and described exemplary embodiments, it is to be distinctly understood that the invention is not limited thereto but may otherwise variously be embodied and practised within the scope of the following claims. Therefore, terms like "preferred" or "in particular" or "particularly", "advantageously" etc. signify optional and exemplary embodiments only.

In particular, the term "planar" is to be understood in its common sense as relating to a plane surface, i.e. to a two-dimensional flat area or plane, thus e.g. excluding (one-dimensional) edges or ridges or even corners or rounded shapes; see also for example the definition on http://en.wiktionary.org/wikiplanar.

Further in particular, the term contact fingers or contact finger cage designates a plurality of elongate, slim, radially deflecting contacting elements that can be arranged in a tulip-like configuration concentrically around the longitudinal axis. The term contact fingers is in contrast to and excludes a contact blade which is not slim, but has a substantial width transversely to its elongation and forms a blade-like broad contacting area such that a single blade provides the full current carrying capability.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMERALS

1=circuit breaker
2=finger support
3*a*=contact fin er of first nominal contact
3*b*=second nominal contact
4*a*=first arcing contact, first arcing contact fingers
4*b*=second arcing contact
5=shell, enclosure
7*a*=first impact area
7*b*=second impact area
8=contact area
9=shielding
10=first transition area
Va=relative axial velocity
Vr=radial velocity
Vrr=relative radial velocity
α=inclination angle
β=compensation angle, deflection angle
z=longitudinal axis (of switching device or of contact arrangement)
d=radial displacement of contact finger, radial deflection of first arcing contact fingers
dmax=radial clearance of contact finger, radial clearance of first arcing contact fingers

What is claimed is:

1. An electrical switching device having a longitudinal axis (z), the electrical switching device comprising:

at least one contact arrangement, the contact arrangement including a first contact and a mating second contact, the first contact including at least one contact finger;

wherein the contact finger is configured to be elastically deformed in a radial direction upon closing the electrical switching device;

wherein for closing and opening the electrical switching device at least one of the first contact and the mating second contact is movable parallel to the longitudinal axis (z) and cooperates with the other contact;

wherein the contact finger includes, at its free end, a first impact area in which a first contacting to the mating second contact occurs when closing the electrical switching device; and wherein the first impact area is formed by a first planar surface which is arranged at an inclination angle (α) larger than zero degrees with respect to the longitudinal axis (z), wherein the first planar surface is a flat area.

2. The electrical switching device of claim 1, wherein the at least one contact arrangement includes an arcing contact arrangement;

wherein the first contact includes a first arcing contact having at least one arcing contact finger; and wherein the mating second contact includes a mating second arcing contact, and wherein for closing and opening the electric switching device, at least one of the first and second arcing contacts is movable parallel to the longitudinal axis (z) and cooperates with the other arcing contact.

3. The electrical switching device of claim 2, wherein the first arcing contact includes a plurality of arcing contact fingers forming an arcing contact finger cage concentric with respect to the longitudinal axis (z); and wherein the mating second contact includes a mating second arcing contact.

4. The electrical switching device of claim 2, wherein the at least one contact arrangement includes a nominal contact arrangement;

wherein the first contact is a first nominal contact having a plurality of nominal contact fingers which form a finger cage concentric with respect to the longitudinal axis (z);

wherein the mating second contact is a mating second nominal contact; and wherein for closing and opening the electric switching device, at least one of the first and second nominal contacts is movable parallel to the longitudinal axis (z) and cooperates with the other nominal contact.

5. The electrical switching device of claim 4, wherein the first contact includes at least one additional contact finger having the same shape as the contact finger.

6. The electrical switching device of claim 5, wherein the contact finger includes a contact area, wherein the first impact area is arranged, when seen along the longitudinal axis (z), between the contact area and a tip of the free end of the contact finger, and wherein the contact finger has contact in the contact area with the second mating contact in an end position of the second mating contact when the electrical switching device is closed.

7. The electrical switching device of claim 1, wherein the at least one contact arrangement includes a nominal contact arrangement;

wherein the first contact includes a first nominal contact having a plurality of nominal contact fingers which form a finger cage concentric with respect to the longitudinal axis (z);

wherein the mating second contact includes a mating second nominal contact; and wherein for closing and opening the electric switching device, at least one of the first and second nominal contacts is movable parallel to the longitudinal axis (z) and cooperates with the other nominal contact.

8. The electrical switching device of claim 7, wherein the nominal contact fingers have the same shape as the first contact which includes at least one arcing contact finger.

9. The electrical switching device of claim 1, wherein the first contact includes at least one additional contact finger having the same shape as the contact finger.

10. The electrical switching device of claim 1, wherein the contact finger includes a contact area, wherein the first impact area is arranged, when seen along the longitudinal axis (z), between the contact area and a tip of the free end of the contact finger, and wherein the contact finger has contact in the contact area with the second mating contact in an end position of the second mating contact when the electrical switching device is closed.

11. The electrical switching device of claim 10, wherein the contact area is formed by a second planar surface which is parallel to the longitudinal axis (z), the second planar surface being a flat area.

12. The electrical switching device of claim 10, wherein in an opened configuration of the electrical switching device, the contact area is formed by a second planar surface which is inclined with respect to the longitudinal axis (z) in an opposite angular direction than an inclination direction of the first impact area by a compensation angle (β), which substantially equals a deflection angle of the contact finger when the electrical switching device is in a closed configuration, the second planar surface being a flat area.

13. The electrical switching device of claim 10, wherein on the contact finger a first transition area between the first impact area and the contact area is rounded, and/or on the second mating contact a mating second transition area of the second mating contact is rounded.

14. The electrical switching device of claim 1, wherein the inclination angle (α) of the first impact area with respect to the longitudinal axis (z) is such that a radial displacement (d) of the contact finger is given by the equation:

$$d = Va \cdot \sin\alpha \cdot \cos\alpha \cdot \sqrt{\left(\frac{m}{k}\right)},$$

with d being radial displacement of the contact finger, m being a mass of the contact finger, k being a finger stiffness of the contact finger, Va being a relative axial velocity of the second mating contact with respect to the first contact at a time of impact, and α being the inclination angle of the first impact area, and wherein the radial displacement (d) is chosen equal or smaller than a radial clearance (dmax) of the contact finger.

15. The electrical switching device of claim 1, wherein the second contact includes at its free end a second impact area, in which a first contacting to the contact finger occurs when closing the electrical switching device, the second impact area being a flat area parallel to the first impact area or the second impact area being rounded.

16. The electrical switching device of claim 1, wherein the inclination angle (α) has a magnitude of not more than 15 degrees and not less than 5 degrees.

17. The electrical switching device of claim 1, wherein the electrical switching device is configured as an earthing device, a fast-acting earthing device, a circuit breaker, a generator circuit breaker, a switch disconnector, a combined disconnector and earthing switch, or a load break switch.

18. A contact arrangement for an electrical switching device, the contact arrangement comprising:

a longitudinal axis (z); and a contact finger, the contact finger including at its free end a first impact area in which a first contacting to a second mating contact of the electrical switching device occurs when closing the electrical switching device;

wherein the contact finger is configured to be elastically deformed in a radial direction upon closing the electrical switching device;

wherein for closing and opening the electrical switching device the first contact is movable parallel to the longitudinal axis (z) and cooperates with the other contact;

wherein the first impact area is formed by a first planar surface which is arranged at an inclination angle (a) larger than zero degrees with respect to the longitudinal axis (z), the first planar surface being a flat area.

19. The contact arrangement of claim 18, further comprising:

an arcing contact arrangement, and an arcing contact finger;

and/or:

a nominal contact arrangement;

wherein the contact finger is a nominal contact finger.

20. The contact arrangement of claim 18, wherein the first contact includes a plurality of contact fingers forming a contact finger cage concentric with respect to the longitudinal axis (z); and wherein the mating second contact includes a mating second arcing contact.

* * * * *